US011668315B2

(12) United States Patent
Marshall et al.

(10) Patent No.: US 11,668,315 B2
(45) Date of Patent: Jun. 6, 2023

(54) COMPOSITE METAL COMPONENT AND METHOD OF PRODUCING SAME

(71) Applicant: Weir Minerals Australia Ltd., Artarmon NSW (AU)

(72) Inventors: Stephen Henry Marshall, Forestville (AU); Timothy Justin Lucey, St. Clair (AU); Lee Jenkins, Halifax (GB); Randy James Kosmicki, Edgerton, WI (US); Ronald Joseph Bourgeois, Sun Prairie, WI (US)

(73) Assignee: Weir Minerals Australia Ltd.

( * ) Notice: Subject to any disclaimer, the term of this patent is extended or adjusted under 35 U.S.C. 154(b) by 0 days.

(21) Appl. No.: 16/956,349

(22) PCT Filed: Dec. 19, 2018

(86) PCT No.: PCT/AU2018/051364
§ 371 (c)(1),
(2) Date: Jun. 19, 2020

(87) PCT Pub. No.: WO2019/119043
PCT Pub. Date: Jun. 27, 2019

(65) Prior Publication Data

US 2020/0332806 A1 Oct. 22, 2020

(30) Foreign Application Priority Data

Dec. 19, 2017 (AU) ..... 2017905071

(51) Int. Cl.
*F04D 29/22* (2006.01)
*F04D 7/04* (2006.01)
*B02C 13/28* (2006.01)

(52) U.S. Cl.
CPC ..... *F04D 29/2294* (2013.01); *F04D 7/04* (2013.01); *B02C 13/28* (2013.01); *B02C 2210/02* (2013.01);
(Continued)

(58) Field of Classification Search
CPC ... B02C 13/28; B02C 2210/02; F04D 29/026; F04D 29/2227; F04D 29/2294;
(Continued)

(56) References Cited

U.S. PATENT DOCUMENTS 2,440,317 A * 4/1948 Welsh ..... F04D 29/2294 416/186 R
5,183,518 A * 2/1993 Radon ..... C21D 5/04 148/324
(Continued)

FOREIGN PATENT DOCUMENTS

CN 101285402 A 10/2008
CN 201346896 Y 11/2009
(Continued)

*Primary Examiner* — Courtney D Heinle
*Assistant Examiner* — Andrew J Marien
(74) *Attorney, Agent, or Firm* — Morriss O'Bryant; Compagni Cannon PLLC

(57) ABSTRACT

A method of producing a composite metal article and/or a composite metal wear component. The method including the following steps: casting a component composed of a host metal composition wherein one or more cavities are formed in the component during casting; inserting a wear resistant composition in solid form into the one or more cavities formed in the component composed of the host metal composition; and, bonding the wear resistant composition into the one or more cavities of the component composed of the host metal composition to form the composite metal article.

31 Claims, 11 Drawing Sheets

(52) U.S. Cl.
CPC .... *F05D 2230/21* (2013.01); *F05D 2300/111* (2013.01)

(58) Field of Classification Search
CPC ..... F04D 29/428; F04D 29/4286; F05D 2300/506; F05D 2230/21
USPC ..... 415/196, 915, 217.1, 200
See application file for complete search history.

(56) References Cited

U.S. PATENT DOCUMENTS

| | | | | |
|---|---|---|---|---|
| 2012/0312907 | A1 | 12/2012 | Gronvall et al. | |
| 2014/0127021 | A1* | 5/2014 | Chiovelli ..... | F04D 29/2294 416/179 |
| 2015/0377246 | A1* | 12/2015 | Tieu ..... | F04D 29/2294 416/189 |

FOREIGN PATENT DOCUMENTS

| | | | |
|---|---|---|---|
| CN | 202203162 | U | 4/2012 |
| CN | 202845750 | U | 4/2013 |
| CN | 107150210 | A | 9/2017 |
| JP | 59215998 | A | 12/1984 |
| JP | 60040661 | A | 3/1985 |
| JP | 530495 | U | 5/1993 |
| JP | 2014237166 | A | 12/2014 |
| RU | 62670 | U1 | 8/2006 |

* cited by examiner

COMPOSITE METAL COMPONENT AND METHOD OF PRODUCING SAME

TECHNICAL FIELD

This disclosure relates in general to a composite metal component and a method of producing same.

BACKGROUND OF THE DISCLOSURE

Various process steps in the minerals processing industry involve erosive contact with components of equipment which results in significant wear to the extent that frequent replacement is required. However, often the wear of a component is uneven depending on the nature of the process step.

For example, in the process of pumping abrasive slurries, a limiting factor on pump wet end component wear life can be localized wear in the form of deep gouging or very high wear rates in certain locations even though other parts of the same component may be wearing at a relatively low rate. Specific examples include (but are not limited to) the leading edge of a slurry pump impeller and the cutwater of a slurry pump liner (also known as a volute).

One approach to address this issue in the example of pump impellers is to fabricate an impeller which involves positioning specially shaped highly wear resistant materials at certain locations during the manufacture of the impeller that are subject to high wear conditions during operation; while retaining relatively lower cost metal in non-critical areas of the impeller. However, this approach can add significant cost, particularly if the wear resistant component is made from an expensive wear resistant material and requires the manufacture of complex three dimensional shapes to conform to the impeller's hydraulic design requirements.

Another attempt to provide localized wear protection for wear components is the application of welded overlays or other cladding type methods where a thin layer of wear resistant material is overlaid onto the metal component composed of the lower cost metal material. However, while these methods may work when applying a thin layer of wear resistant material to wear components with flat surfaces, wear components in the form of complex shapes such as a pump impeller or a pump liner are not readily amenable to this method.

It is also the case that many other wear components used in mineral processing equipment, such as crushers and grinding mills also suffer from premature failure due to localized wear. It is envisaged that the present invention will also benefit these types of equipment as well.

The present invention seeks to provide a relatively low cost composite metal wear component and a method for producing same that provides a wear component that includes localized wear protection for use in the minerals processing industry.

SUMMARY

According to one aspect there is provided a method of producing a composite metal article including the following steps:

(i) casting a component composed of a host metal composition wherein one or more cavities are formed in the component during casting;

(ii) inserting a wear resistant composition in solid form into the one or more cavities formed in the component composed of the host metal composition; and, (iii) bonding the wear resistant composition into the one or more cavities of the component composed of the host metal composition to form the composite metal article.

In certain embodiments, the casting step (i) includes the following steps:

(ia) positioning one or more cavity forming portions into a mould for the component;

(ib) introducing the host metal composition in liquid form into the mould whereby the host metal composition surrounds the one or more cavity forming portions; and, (ic) allowing the host metal composition in the mould to cool and solidify forming the component composed of the host metal composition.

In certain embodiments, the one or more cavity forming portions is composed of a material that has a coefficient of thermal expansion that is similar, or substantially the same, as the coefficient of thermal expansion of the host metal composition.

In certain embodiments, the one or more cavity forming portions is removed from the host metal composition to reveal the one or more cavities after step (ic).

In certain embodiments, the one or more cavity forming portions is removed from the host metal composition by drilling and/or otherwise machining the component composed of the host metal composition after step (ic).

In certain embodiments the one or more cavity forming portions is composed of a material selected from steel or another metal alloy, carbon or graphite.

In certain embodiments, the one or more cavity forming portions is at least partially fragmented as the host metal composition in the mould solidifies due to shrinkage of the host metal composition during step (ic).

In certain embodiments, the one or more cavity forming portions includes a hollow centre.

In certain embodiments, the one or more cavity forming portions has a higher softening point temperature than the liquid pouring temperature of the host metal composition.

In certain embodiments, the one or more cavity forming portions are cylindrical or cuboid in shape.

In certain embodiments, the component composed of the host metal composition is heat treated and/or undergoes a tempering treatment to remove any residual stresses resulting from the formation of the one or more cavities after the one or more cavity forming portions is removed from the component composed of the host metal composition.

In certain embodiments, the host metal composition is selected from a high chromium white cast iron.

In certain embodiments, the wear resistant composition has an increased wear resistance than the host metal composition.

In certain embodiments, the wear resistant composition is selected from tungsten carbide. In one form the tungsten carbide includes a coarse grain size. In a further form the grain size of the tungsten carbide is 2 to 6 micrometers.

In certain embodiments, the wear resistant composition is cylindrical, cuboid or button shaped.

In certain embodiments, the wear resistant composition is bonded into the one or more cavities in the host metal using an adhesive or by using a brazing method.

In certain embodiments, the composite metal article is a wear component.

In certain embodiments the one or more cavities are located within the body of the composite metal article adjacent to a wear surface of the wear component.

In certain embodiments, the wear component is part of an apparatus used in mineral processing. In this form, the apparatus used in mineral processing may be selected from a centrifugal slurry pump, grinding mill, crusher or wear plate.

In certain embodiments, the wear component is selected from a slurry pump impeller or a liner for a centrifugal slurry pump.

According to another aspect there is provided a composite metal article produced by the method described herein.

According to another aspect there is provided a composite metal wear component including:

a main body portion composed of a host metal composition, the main body portion including one or more cavities located therein; and, a wear resistant composition bonded at least partially within the one or more cavities of the main body portion, wherein the one or more cavities are formed during casting of the main body portion.

In certain embodiments the one or more cavities are located within the main body portion of the composite wear component adjacent to a wear surface of the composite metal wear component.

In certain embodiments, the composite metal wear component is part of an apparatus used in mineral processing. The apparatus used in mineral processing may be selected from a centrifugal slurry pump, grinding mill, crusher or wear plate.

According to another aspect there is provided a composite metal wear component for use with a centrifugal slurry pump, the composite metal wear component including:

a main body portion composed of a host metal composition, the main body portion including one or more cavities located therein; and, a wear resistant composition bonded at least partially within the one or more cavities of the main body portion.

In certain embodiments, the one or more cavities is/are formed during casting of the main body portion, or the one or more cavities is/are machined into the main body portion.

In certain embodiments, the composite metal wear component is a slurry pump impeller or a liner for a centrifugal slurry pump.

According to another aspect there is provided a slurry pump impeller including a back shroud with an inner main face with an outer peripheral edge and a central axis, a plurality of pumping vanes extending away from the inner main face of the back shroud, the pumping vanes being disposed in spaced apart relation, each pumping vane including opposed main side faces, a leading edge in the region of the central axis and a trailing edge in the region of the outer peripheral edge of the back shroud with a passageway between adjacent pumping vanes, wherein the pumping vanes include one or more cavities located therein and wherein a wear resistant composition is bonded at least partially within the one or more cavities.

In certain embodiments, the slurry pump impeller includes a front shroud having an inner main face wherein the plurality of pumping vanes extend between the inner main faces of the back and front shrouds.

In certain embodiments, each of the plurality of pumping vanes includes at least one cavity. In certain embodiments, the one or more cavities are located within a body portion of each of the plurality of pumping vanes whereby the wear resistant composition is not exposed to the passageway between adjacent pumping vanes.

In certain embodiments, the one or more cavities each include an opening located in a top surface of the plurality of pumping vanes between the opposed main side faces and remote from the back shroud.

In certain embodiments, the one or more cavities extend through the body portion of each of the plurality of pumping vanes from the opening towards the back shroud.

In certain embodiments, the one or more cavities extend through the body portion of each of the plurality of pumping vanes from the opening until in line with where the plurality of the pumping vane meets the back shroud.

In certain embodiments, the one or more cavities are located proximal to the leading edge of the plurality of pumping vanes.

In certain embodiments, the one or more cavities are located within about 5 mm to about 25 mm from the leading edge of the plurality of pumping vanes.

In certain embodiments the wear resistant composition is gradually exposed as the pumping vanes are subjected to wear in use.

According to another aspect there is provided a pump liner for a centrifugal slurry pump, the pump liner including a main pumping chamber having:

an inlet opening for the introduction of flow of material into the main pumping chamber during use;

a discharge outlet extending from the main pumping chamber and arranged for the exit of a flow of material from the main pumping chamber during use; and a transition surface extending between an inner peripheral surface of the main pumping chamber and an inner peripheral surface of the discharge outlet, the transition surface including a cutwater arranged for separating an in use exit flow of material in the discharge outlet from an in use recirculation flow of material in the main pumping chamber; wherein the region of the transition surface includes include one or more cavities located therein and wherein a wear resistant composition is bonded at least partially within the one or more cavities.

In certain embodiments the one or more cavities are located within a body portion of the region of the transition surface whereby the wear resistant composition is not exposed to the main pumping chamber.

In certain embodiments the one or more cavities each include an opening located in an outside surface of the pump liner in the region of the transition surface.

In certain embodiments the pump liner includes at least one cavity which includes two openings located on an outside surface on opposite sides of the pump liner wherein the wear resistant composition is located proximal to the cutwater.

In certain embodiments, the one or more cavities are located within about 5 mm to about 25 mm from transition surface.

In certain embodiments, the wear resistant composition is gradually exposed as the cutwater and/or the transition surface is subjected to wear in use.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
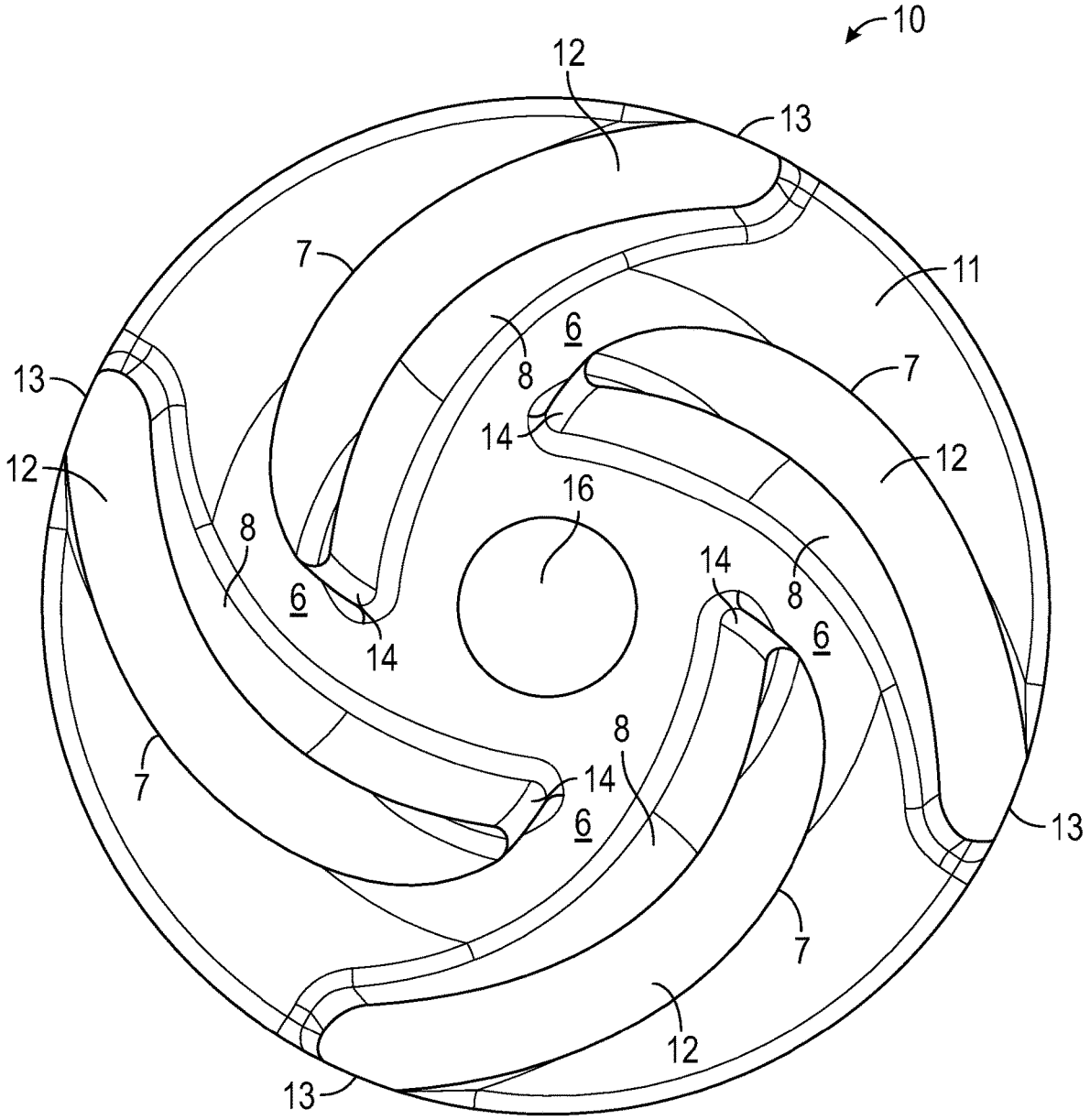
FIG. 1 is a front cross-section schematic view of a slurry pump impeller for a centrifugal slurry pump.

By means of the method described herein, it was found that a composite metal article may be produced which finds application as a wear component for use in the minerals processing industry. In particular, it was found that when one or more cavities were formed during the casting process of a metal component, the one or more cavities did not significantly effect the structural integrity of the metal component and also allowed for a wear resistant composition in solid form to be bonded into the one or more cavities to produce a composite metal article with increased wear resistance properties.

In certain embodiments, the method as described herein may be used to produce a composite metal wear component which includes the wear resistant composition inserted and bonded within the component adjacent or proximal to regions of the wear component that are subject to significant wear in use. For example, the method as herein described may be used to produce a composite metal slurry pump impeller which may be composed of a host metal composition including a wear resistant material bonded within cavities formed during the casting process of the host metal composition. The wear resistant material may be bonded within cavities that may be located in within the body of the slurry pump impeller composed of the host metal composition adjacent, or proximal to the leading edge of the pumping vanes of the slurry pump impeller, and/or located in the body of the impeller at other locations that may be subject to significant wear in use In certain embodiments other types of composite metal wear components may be produced where the wear resistant material may be bonded within cavities located adjacent, or proximal to areas subject to significant wear. For example, a metal liner for a centrifugal slurry pump may be produced from a host metal composition which includes a wear resistant material bonded within cavities located adjacent or proximal to the cutwater of the metal liner. Further examples of types of metal wear components may be produced in accordance with the method described which may find application for use with grinding mills, crushers and wear plates.

In certain embodiments, the wear resistant material is located such that it is encased within the main body of the metal wear component where the main working surfaces of the metal wear component are composed of the host metal composition. This allows that the working surfaces of the wear component are not hydrodynamically altered by the inclusion of the wear resistant material. It this embodiment, when the main body of the metal wear component begins to wear during use, the metal wear component becomes exposed which then slows down the rate of wear experienced by the metal wear component.

In an embodiment there is provided a method of producing a composite metal article that may be used as a composite metal wear component. The method includes the following steps:

(i) casting a component composed of a host metal composition wherein one or more cavities are formed in the component during casting;

(ii) inserting a wear resistant composition in solid form into the one or more cavities formed in the component composed of the host metal composition; and, (iii) bonding the wear resistant composition into the one or more cavities of the component composed of the host metal composition to form the composite metal article.

In the method as herein described, casting step (i) may include positioning one or more cavity forming portions into a mould for the component. The mould for the component may be in the shape of the composite metal article which may be for a composite metal wear component. The cavity forming portions provide that when a host metal composition is introduced into the mould in liquid form, the host metal composition surrounds the cavity forming portions providing that the locations of the mould taken up by the cavity forming portions are not filled with the liquid host metal composition. It is at these locations that the cavities are formed. As a result, the cavity forming portions are shaped to provide the subsequent interior surface shape of the cavities. In a preferred form, the cavity forming portions are cylindrical or cuboid in shape which results in cavities having an interior surface shape that is cylindrical or cuboid in form.

The host metal composition in the mould is allowed to cool and solidify forming the component composed of the host metal composition. The cavity forming portions may be located within the host metal composition once the component has cooled and solidified. Alternatively, the cavity forming portions may be formed of a material that fractures, or otherwise structurally degrades due to the shrinkage of the host metal composition as it cools and solidifies.

To provide the cavities in the host metal component after the liquid host metal has cooled and solidified, the one or more cavity forming portions or remaining fragments thereof may be removed from the host metal composition. Suitable removal techniques may involve drilling and/or otherwise machining the component.

In an embodiment the one or more cavity forming portions may be formed from a material that has a coefficient of thermal expansion that is similar, or substantially the same, as the coefficient of thermal expansion of the host metal composition. In addition, the cavity forming portions may have a higher softening temperature than the liquid pouring temperature of the host metal composition. For example, the one or more cavity forming portions may be composed of a material selected from steel or another metal alloy, or the one or more cavity forming portions may be composed of carbon or graphite.

In an embodiment the one or more cavity forming portions include a hollow centre. Such a form may encourage the one or more cavity forming portions to fracture or otherwise structurally degrade due to the host metal composition shrinking as it cools and solidifies during the casting step. The cavity forming portions including a hollow centre may be cylindrical or cuboid in shape and may be formed from materials such as glass or quartz glass. Prior to inserting the cavity forming portions with a hollow centre into the mould, the cavity forming portions may be pre-weakened, for example, by scratching the surface of the cavity forming portion. The pre-weakening may further encourage the one or more cavity forming portions to fracture or otherwise structurally degrade during the casting process which facilitates the removal during the method as described.

Following the removal of the cavity forming portions from the component formed from the host metal composition, the component may be heat treated or subjected to a tempering treatment to remove any residual stresses resulting from the formation of the one or more cavities.

The host metal composition may be selected from any suitable metal or metal alloy that is appropriate for casting wear components, such as for example high chromium white cast iron. The wear resistant composition would ideally have an increased wear resistance than the host metal composition and may be chosen from a material with a very high wear resistance such as tungsten carbide. The tungsten carbide may be sintered and/or may have a grain size of 2 to 6 micrometers. In a preferred form, the wear resistant composition is cylindrical, cuboid or button shaped or is of another form that is commonly manufactured. A commonly manufactured form such as cylindrical, cuboid or button shape has been found to be generally less expensive than other more irregular shapes which reduces the cost of producing the composite metal wear component as herein described.

In an embodiment the wear resistant composition is bonded into the one or more cavities in the host metal using an adhesive. The adhesive may have high gap filling capabilities and high tensile strength. For example, the adhesive may be selected from LOCTITE EA 9497 or 3M Scotch-weld 7236 B/A or other structural epoxy adhesive; or a high strength retaining compound such as Loctite 620, Loctite 638 or Loctite 660. As an alternative the wear resistant composition is bonded into the one or more cavities by using a brazing method. As a further alternative, or in addition to the above mentioned bonding examples, the wear resistant component may be bonded into the one or more cavities via a mechanical locking arrangement such as for example a threaded plug, a shrink-fit plug or a close-fit plug secured by a high-strength retaining compound; these measures being employed to prevent the wear resistant component from coming out of the cavity in which it is secured during operation of the equipment.

Referring to FIG. 1 there is shown a cross-section of a wear component in the form of a centrifugal slurry pump impeller 10, the impeller 10 includes a back shroud 11 with four pumping vanes 12 extending from the shroud in a direction generally in line with an axis of rotation of the slurry pump impeller when in use. The four pumping vanes 12 each include a trailing edge 13 and a leading edge 14, where the leading edge 14 of the pumping vanes is adjacent the centre, or eye, 16 of the impeller 10 where the slurry enters during operation of an associated centrifugal slurry pump (not shown). The slurry passes via the eye and then is moved due to the rotation of the impeller through the passageways 6 between the pumping vanes 12. The pumping vanes further include opposed main side faces 7, 8 which define the passageways together with the back 11 and front shroud 21 (not shown in FIG. 1). The location and function of the leading edge 14 of the pumping vanes 12 means that this part of the slurry pump impeller 10 is subjected to significant impact erosion and wear during the operation of a centrifugal slurry pump which means the leading edge 14 is often the location of a high degree of wear.

Figure 2:
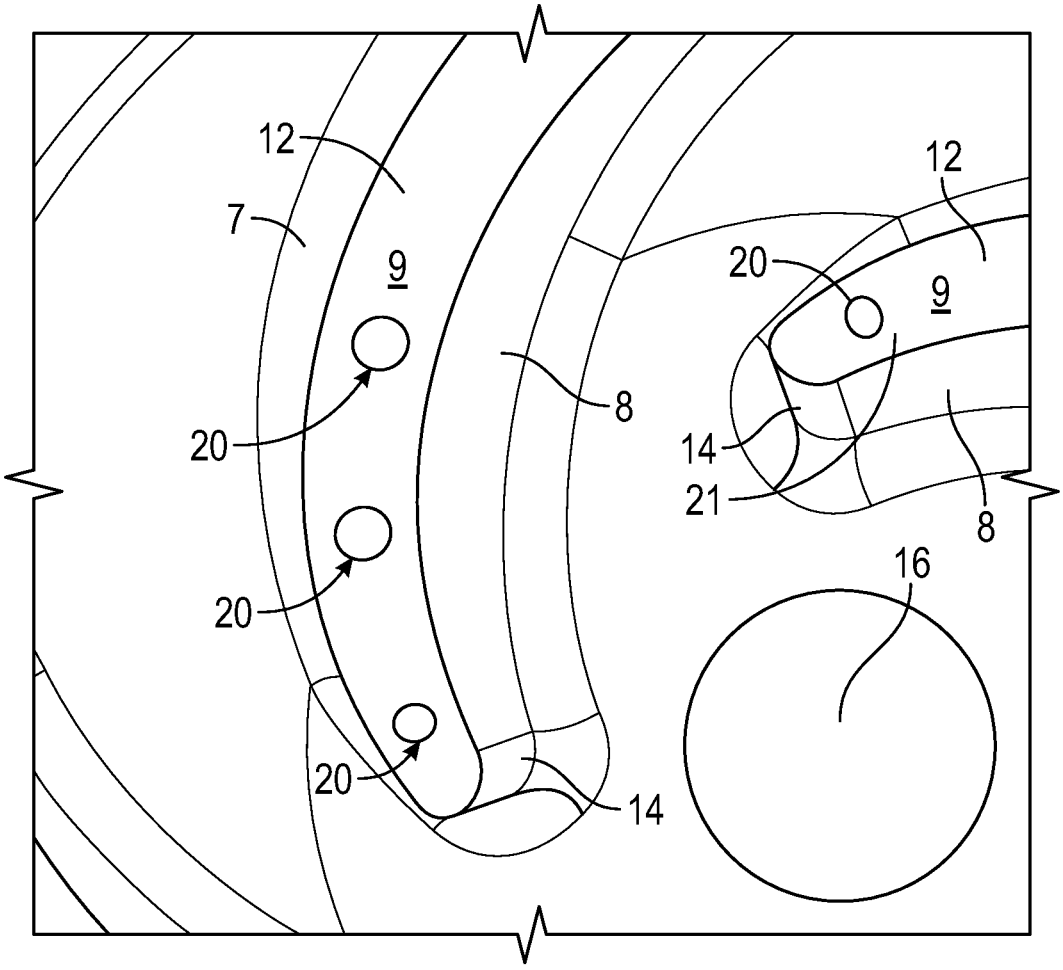
FIG. 2 is close up cross-section schematic view of a pumping vane of a pump impeller for a centrifugal slurry pump in accordance with an embodiment.

Referring to FIG. 2 there is shown a close up cut-section view of a portion of a pumping impeller in the general form of the impeller of FIG. 1. As shown in FIG. 2, a number of cavities 20 can be seen located within the impeller in a body portion of the pumping vanes 12 between the opposed main side faces of the pumping vanes 12. Openings 22 of the cavities 20 are located in a top surface 9 of the pumping vanes 12 and the cavities extend from the top surface 9 to within the body of the pumping vane 12 towards the back shroud 11. The cavities 20 may be formed such that they pass into the body of the shroud of the impeller 11 in a direction generally in line with the direction of the rotation axis, and they may extend until the base of the cavity is in line with where a base of the pumping vane 12 meets the back shroud 11.

Figure 3:
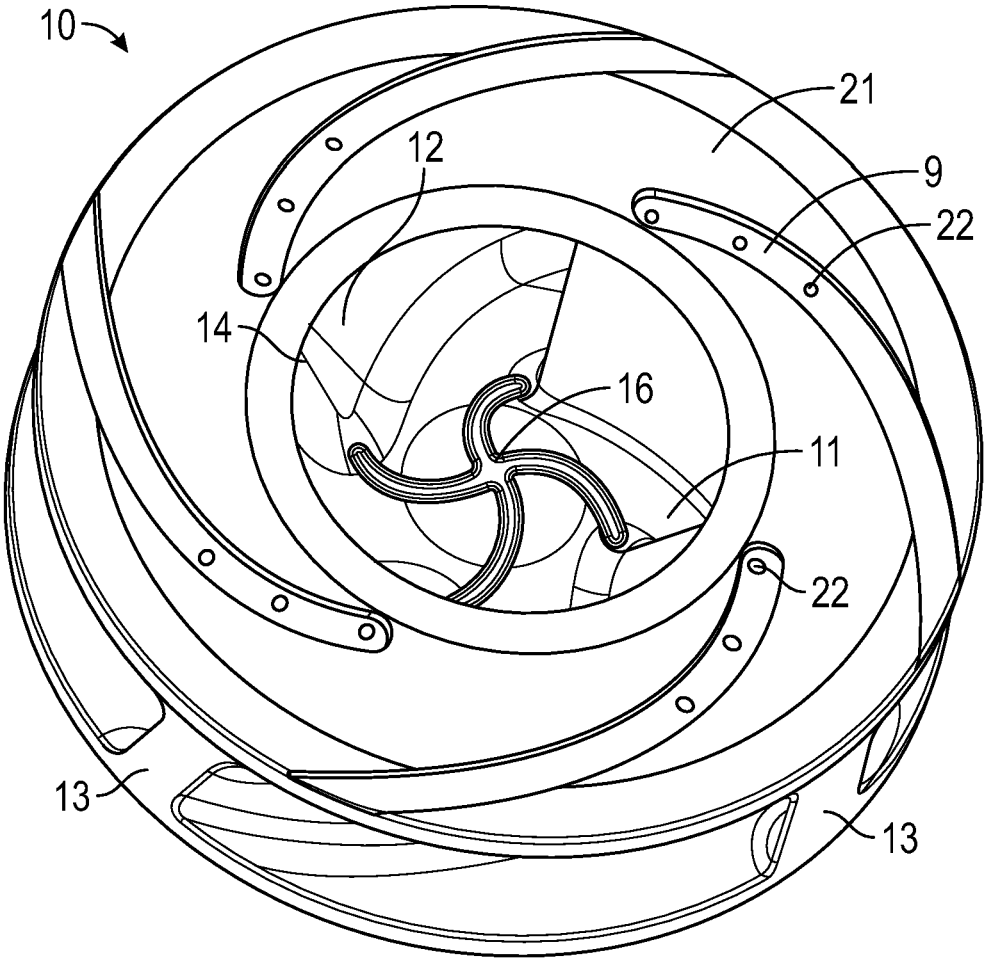
FIG. 3 is a perspective view of a slurry pump impeller for a centrifugal slurry pump in accordance with an embodiment.

Referring to FIG. 3 there is shown a schematic view of an impeller for a centrifugal slurry pump in the general form of the impeller of FIG. 1 where the front shroud 21 is shown. Openings 22 of the cavities 20 are located in the front shroud of the impeller 21 and the cavities extend within the body of the pumping vanes 12 towards the rear shroud 11. The cavities may be formed such that they pass into the body of the shroud of the impeller 11 in a direction that is generally in line with the rotation axis, and the cavities 20 may stop at the point which is in line where a base of the pumping vane 12 meets the shroud 11. The cavities 20 may be in a cylindrical form with the opening 22 at one end and a bottom end at the other (not shown) and side walls. The cavities may include a central axis line which is generally parallel to the opposed side walls of the pumping vanes extending between the front 21 and back shroud 11.

The cavities 20 shown in FIG. 2 have a circular opening 22 and a generally cylindrical shape as they extend into the body of the pumping vane 12. The cavities 20 are provided during the casting process of the impeller using a method as described above. The shape of the cavities shown in FIG. 2. indicate that cylindrical cavity forming portions were used during the casting process and that the cavity forming portions have been subsequently removed leaving the cavities remaining in the pumping vanes 12 of the impeller 10.

Figure 4:
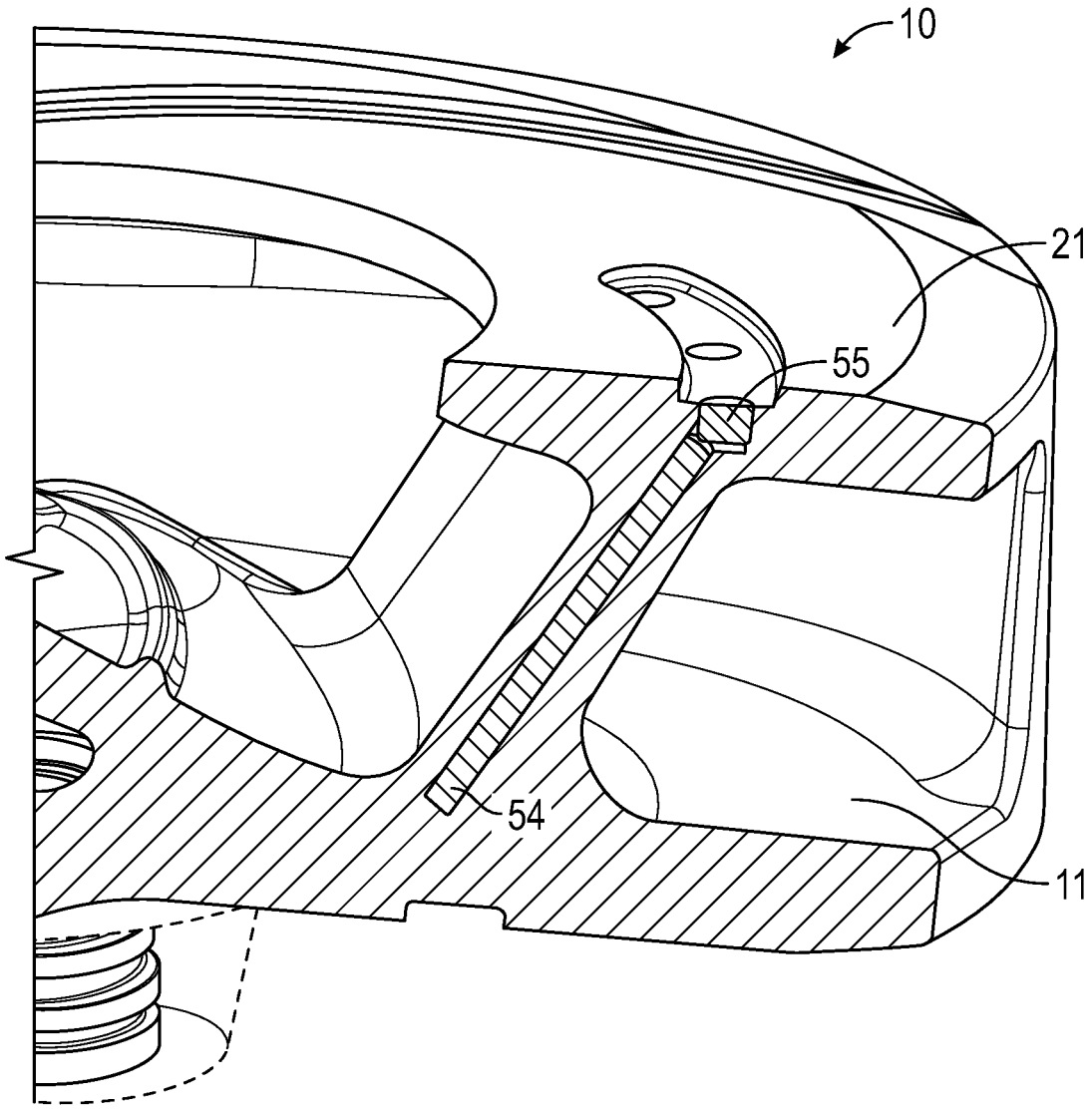
FIG. 4 is a cross-sectional view of a pumping vane of a slurry pump impeller for a centrifugal slurry pump in accordance with an embodiment.

A wear resistant material that may be in the form of a cylinder which may be slightly smaller in diameter to the cavities 20 may be inserted into the cavities after the impeller has been cast. The wear resistant material may be composed of any suitable material that has an increased wear resistance compared to the metal composition used to cast the body of the impeller. In a preferred form the wear resistant material may be selected from cylinders of sintered tungsten carbide that are of a cylindrical shape that is slightly smaller than the cavities 20. The wear resistant material may be bonded within the cavities by use of an adhesive or by using a brazing method. In FIG. 4. the wear resistant material 54 may be further secured using a mechanical bonding method such as a threaded plug 55, a shrink-fit plug or a close-fit plug secured by a high-strength retaining compound. Once bonded within the cavities, the wear resistant material 54 provides that the pumping vanes 12 of the impeller 14 are of a composite form where the body of the pumping vane 14 is composed of the metal composition used to cast the impeller and the cavities 20 are filled with the wear resistant composition.

The impeller 10 as shown in FIG. 2. includes a leading edge which is composed of the metal composition used to cast the impeller 10. Adjacent, or proximal to the leading edge is a cavity 20 which includes a wear resistant material bonded within. The number of cavities 20 with wear resistant material inserted and bonded therein and the spacing of these structures on the impeller body 10, ensures that any residual stresses in the host metal composition of the impeller will be lower than the yield strength of that host metal material composition. Additionally, these stresses may be reduced or eliminated by subsequent heat treatment. As can be seen, the location of the cavities 20 and the wear resistant material bonded therein provides that the wear resistant material is not exposed to the passageways 6 through the impeller. This provides that the alteration of the slurry pump impeller with the inclusion of the wear resistant material at certain locations does not affect the hydrodynamic properties of the impeller.

In use, the metal composition of the impeller 10 will begin to wear in certain locations such as the leading edge 14 of the pumping vane 12. This will eventuate in the enhanced wear resistant material becoming exposed to the abrasive process conditions in the operation of the centrifugal slurry pump. At this time, the rate of wear will decrease due to the increased wear resistance of the wear resistant material bonded within the cavities 20. This has the advantageous effect of reducing the overall wear rate of the impeller 10 and increasing its working life.

Figure 5:
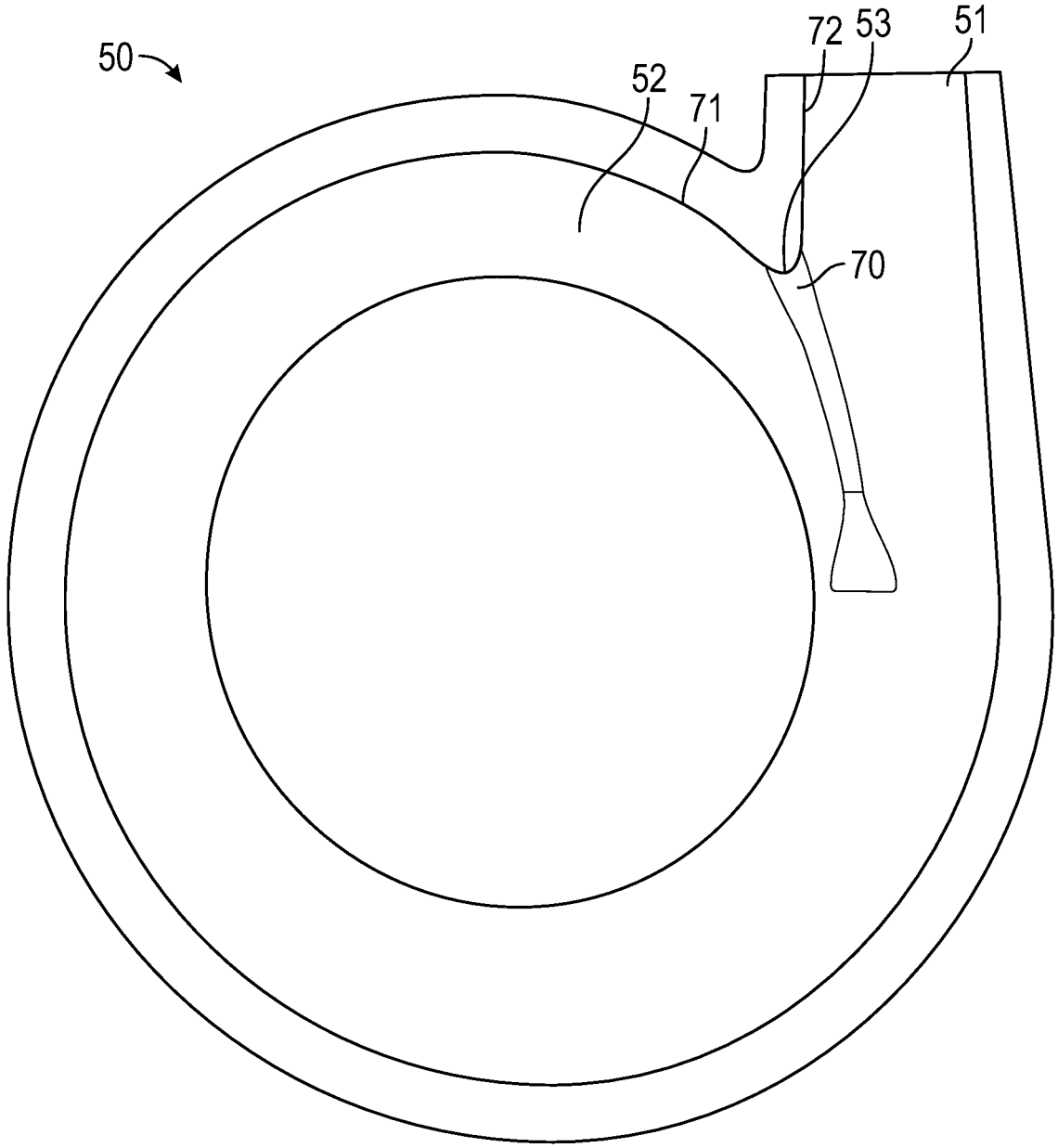
FIG. 5 is cross-sectional view of a liner for a centrifugal slurry pump.
Figure 6:
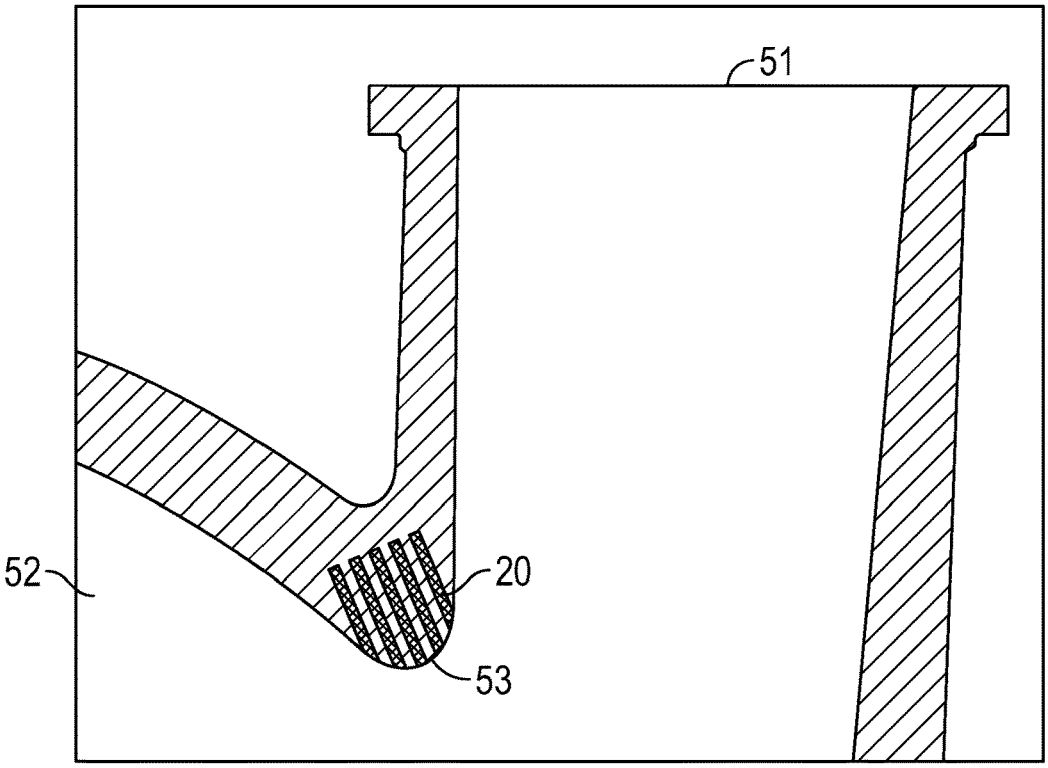
FIGS. 6-11 are a close up schematic views of a cut-water of a liner for a centrifugal slurry pump in accordance with various embodiments.
Figure 7:
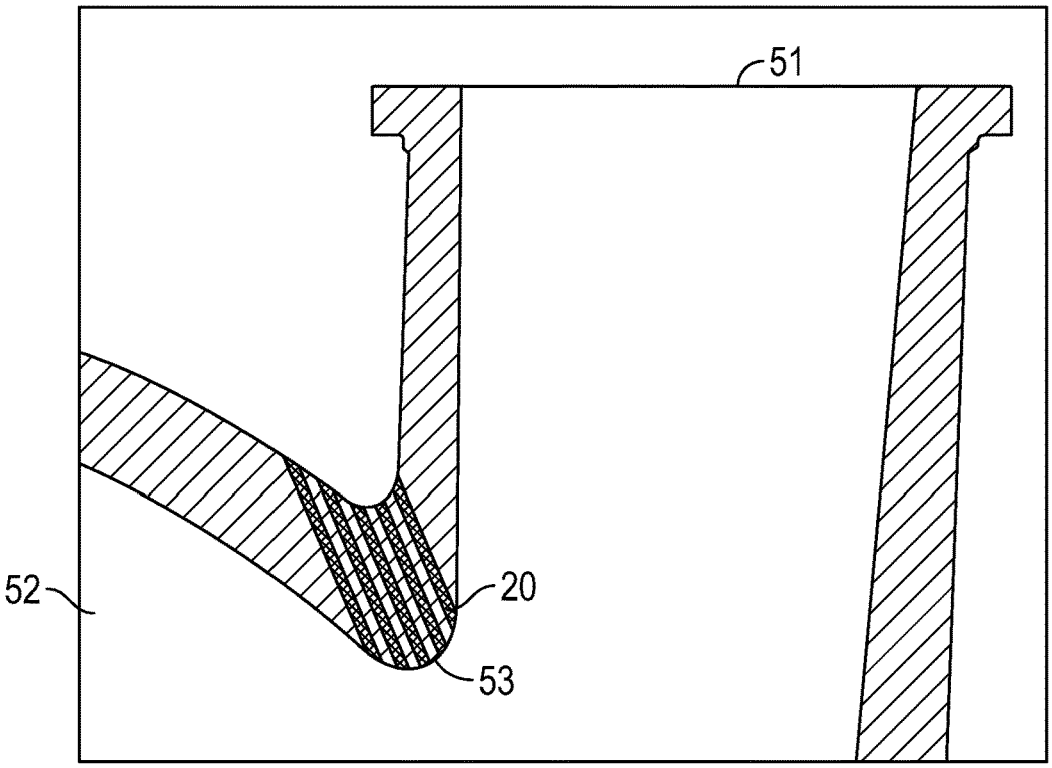
Figure 8:
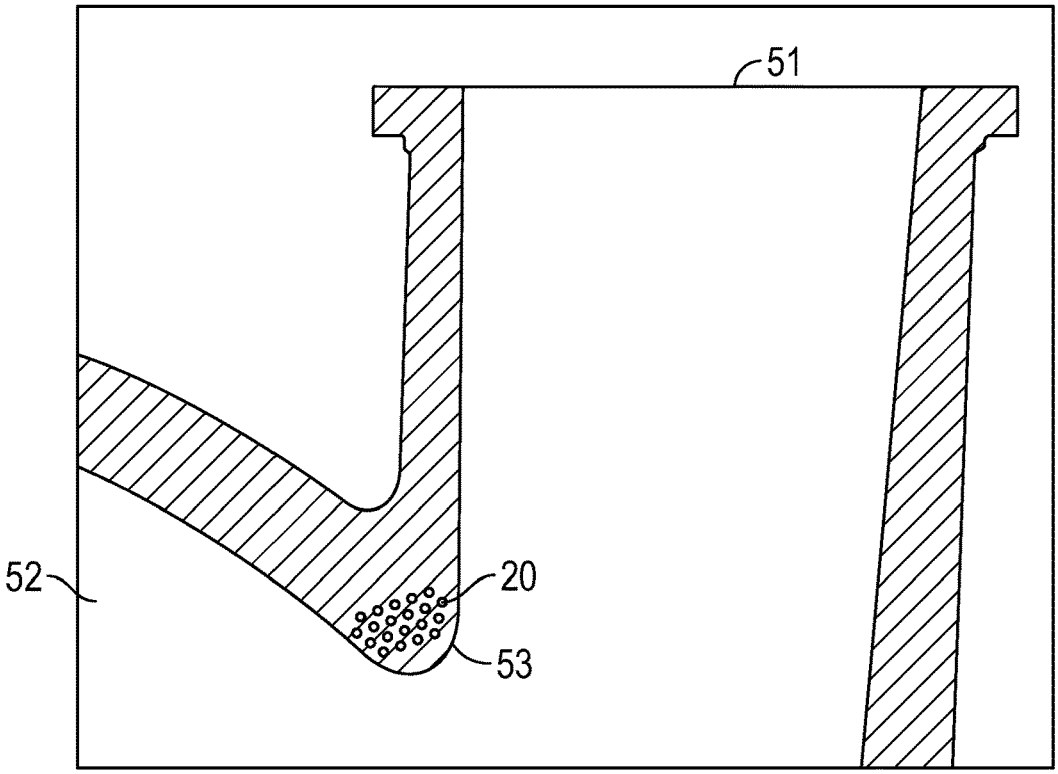
Figure 9:
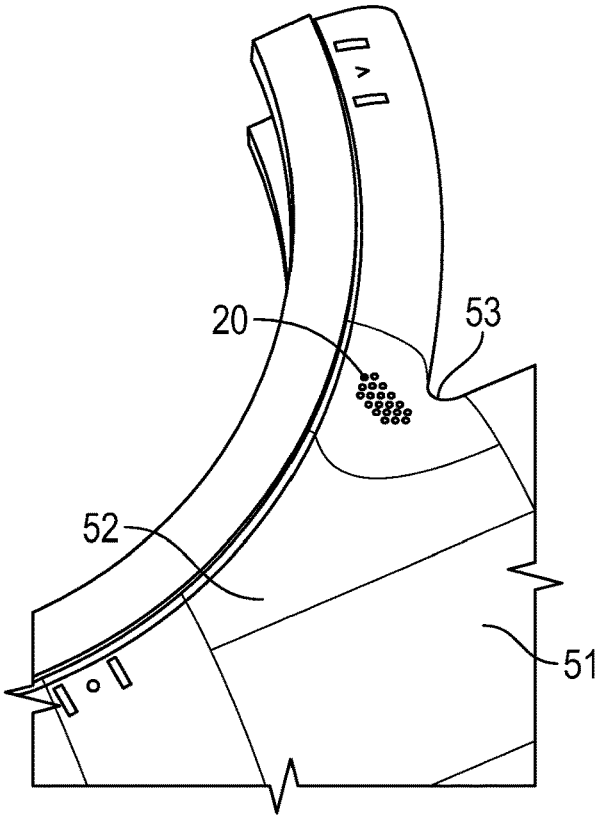
Figure 10:
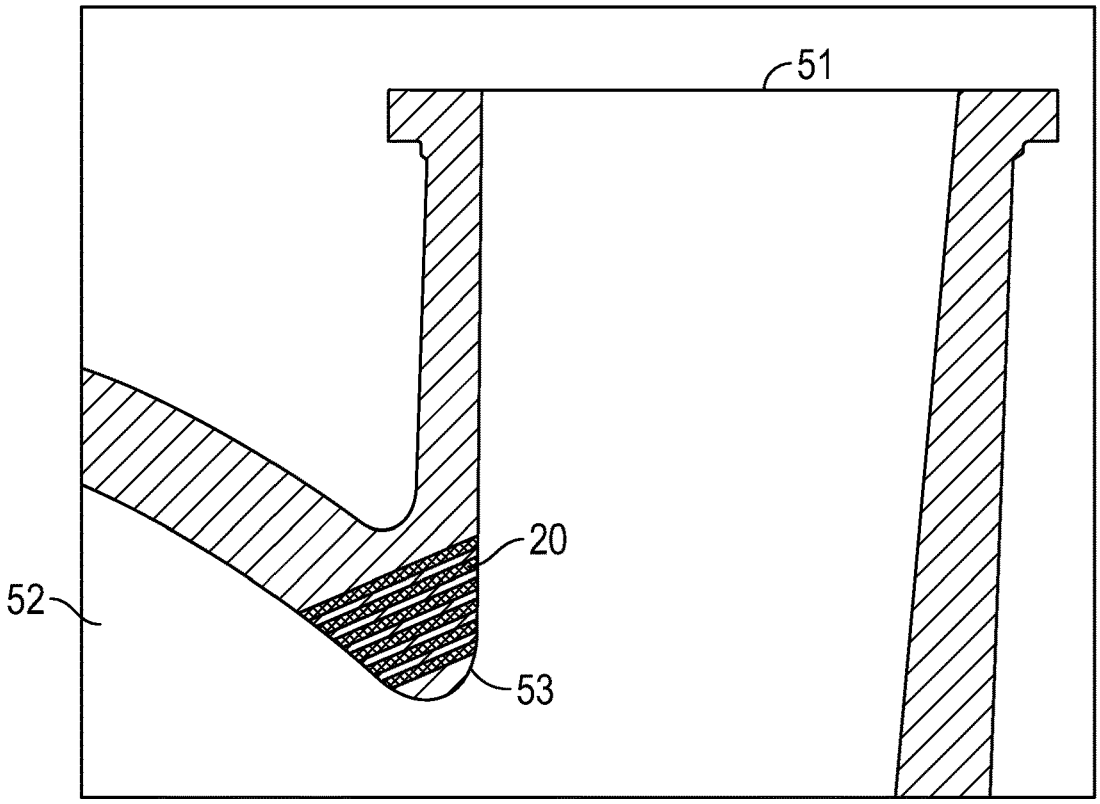
Figure 11:
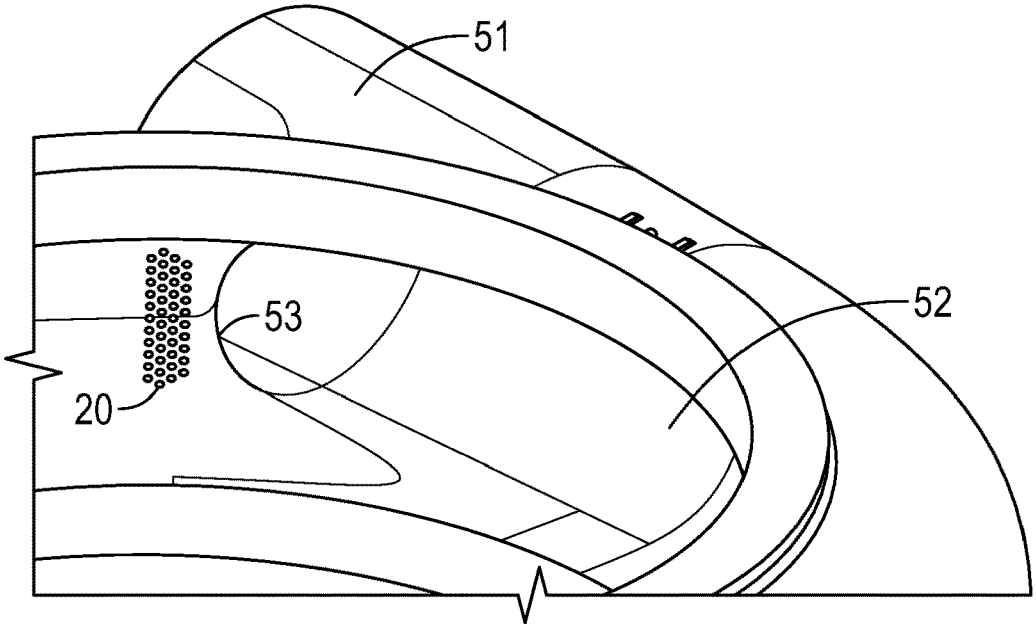

FIG. 5 depicts an alternative embodiment of a wear component which is in the form of a liner 50 for a centrifugal slurry pump. The liner 50 is in the form of a volute and includes a pumping chamber 52 and an outlet 51. The liner 50 includes a transition surface 70 extending between an inner peripheral surface 71 of the main pumping chamber and an inner peripheral surface of the discharge outlet 72, where the transition surface includes a cutwater 53. A cutwater 53 is a portion of the liner 50 which separates the flow of slurry from the pumping chamber 52 and the outlet 51 when in use during the operation of a centrifugal slurry pump. The cutwater 53 is often the location of significant impact erosion wear during the slurry pumping operation.

FIGS. 6 to 11 depict alternative embodiments where cavities 20 are formed during the casting process of the liner 50 at locations adjacent or at the cutwater 53 of the liner 50. The liner would typically be composed of a host metal composition and a wear resistant material would be subsequently bonded within the cavities 20 using an adhesive or brazing method. The wear resistant material may be selected from sintered tungsten carbide may be in the form of cylindrical rods.

Figure 12A:
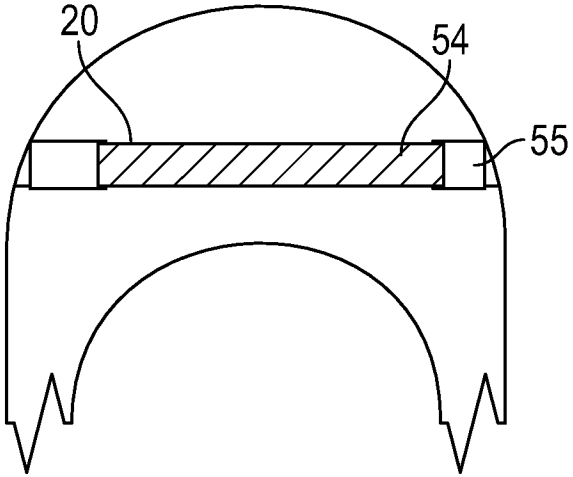
FIG. 12A a sectional view of the liner of FIG. 12.
Figure 12:
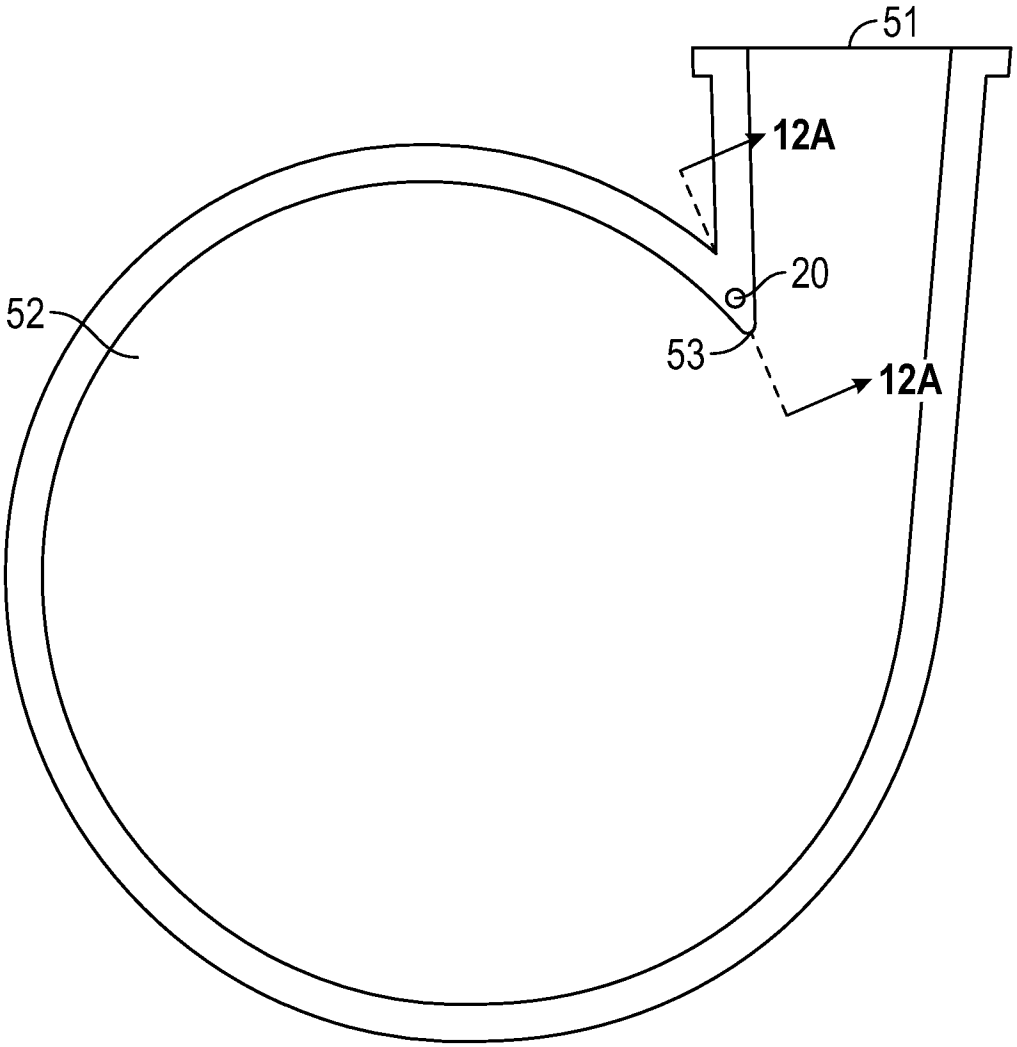
FIG. 12 is a is cross-sectional view of a liner for a centrifugal slurry pump in accordance with an embodiment.
Figure 13:
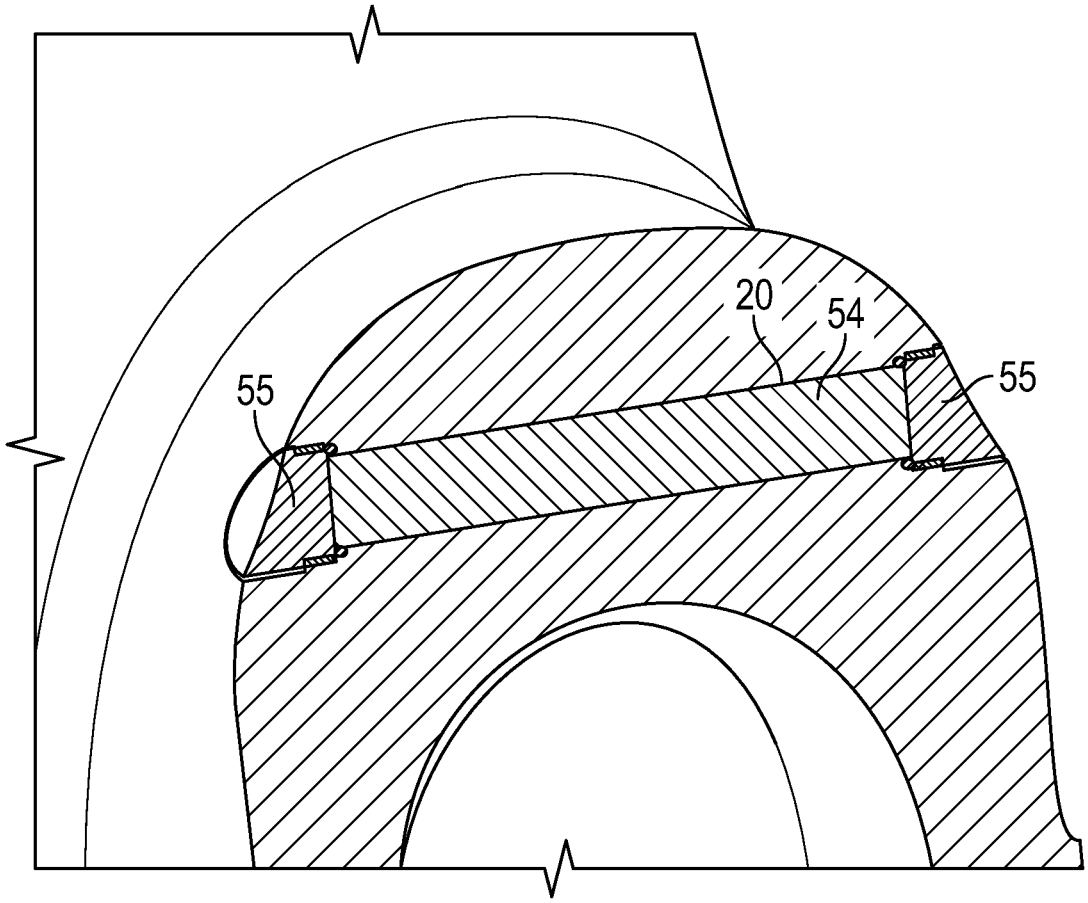
FIG. 13 is a cut away view of liner in accordance with an embodiment.

FIGS. 12, 12A and 13 depict an embodiment where a cavity 20 is formed during the casting process of the liner 50 at the cutwater where the cavity lies in a direction that passes from one side of the liner 50 to the other side of the liner 50 which provides that the cavity is substantially parallel to with the rotational axis of the pump impeller. The cavity 20 may alternatively be machined into the cutwater after casting. Subsequent to formation of the cavity 20, a hard insert 54 is inserted into the cavity and secured in position by means of adhesive bonding and by mechanical means which in this case is in the form of threaded plugs 55 located at each end of the cavity 20. As can be seen, the location of the cavities 20 and the wear resistant material 51 bonded therein provides that the wear resistant material is not exposed to the pumping chamber 51 or discharge outlet 52 of the liner 50. This provides that the alteration of the liner with the inclusion of the wear resistant material proximal or adjacent to the surface of the cutwater 53 does not affect the hydrodynamic properties of the liner. In use, the metal composition of the liner 50 will begin to wear in certain locations such as the cutwater 53. This will eventuate in the enhanced wear resistant material becoming exposed to the abrasive process conditions in the operation of the centrifugal slurry pump. At this time, the rate of wear at the location of the cutwater will decrease due to the increased wear resistance of the wear resistant material bonded within the cavity 20. This has the advantageous effect of reducing the overall wear rate of the liner 50 and increasing its working life.

Figure 14:
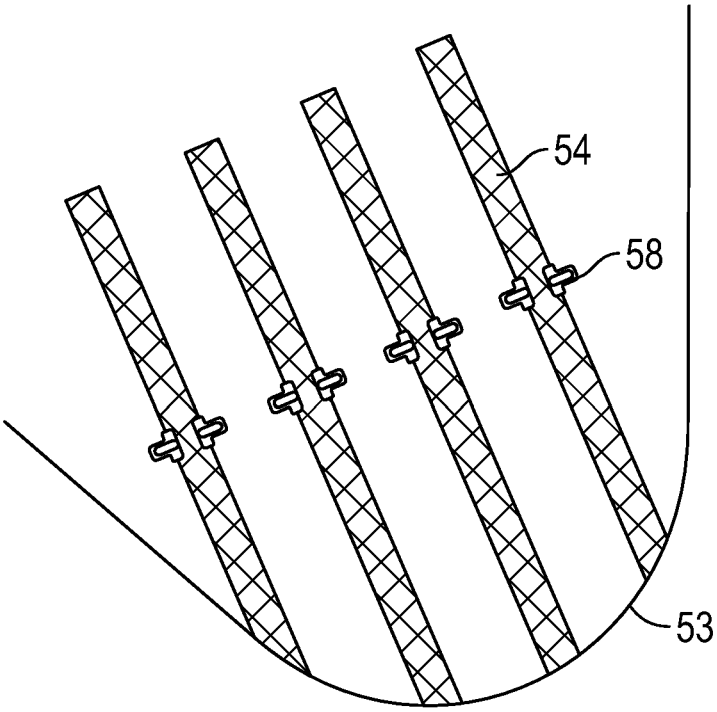
FIGS. 14 & 15 depicts schematic views of a cut-water of a liner for a centrifugal slurry pump in accordance with other embodiments.
Figure 15:
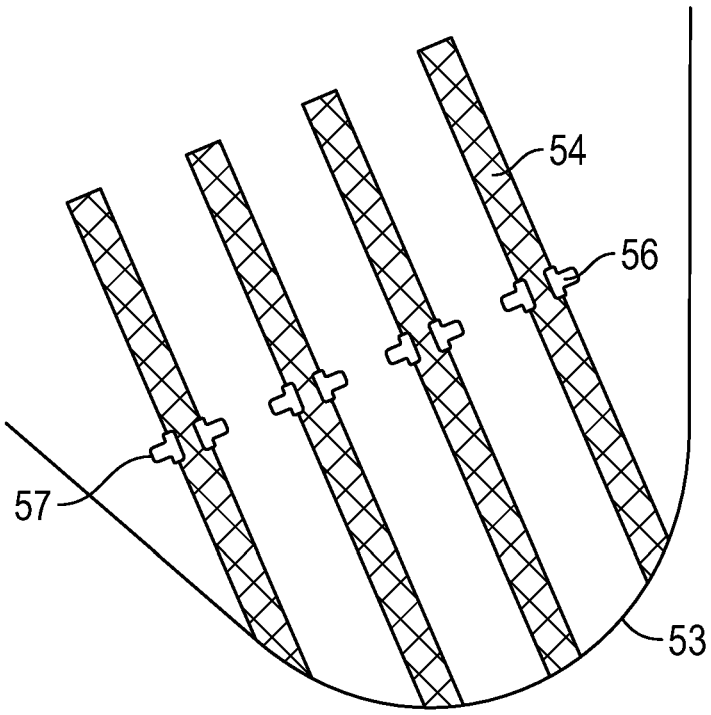

FIGS. 14 and 15 depicts and embodiment where the hard insert 54 is provided with a notch 56 and a corresponding notch 57 is provided in the cavity 20. This allows for the optional use of a snap ring 58 to mechanically secure the hard insert in position.

A further advantage of the method described herein is the modification required to the original wear component casting is the location of cavity forming portions in a standard wear component mould. This will result in a final casting that is in appearance exactly the same as the original part, except that it will have cavities provided for insertion of the wear resistant material.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

LIST OF PARTS passageways 6
opposed side faces 7,8
top surface 9 impeller 10
back shroud 11
pumping vane 12
trailing edge 13
leading edge 14
impeller eye 16
cavity 20
front shroud 21
opening 22
liner 50
pumping chamber 52
outlet 51
cutwater 53
hard insert 54
threaded plug 55
notch in hard insert 56
notch in cavity 57
snap ring 58
transition surface 70
inner peripheral surface of the pumping chamber 71
inner peripheral surface of the discharge outlet 72

The invention claimed is:

1. A method of producing a composite metal centrifugal slurry pump wear component including the following steps:

(i) casting a centrifugal slurry pump wear component composed of a host metal composition wherein one or more cavities are formed in the centrifugal slurry pump wear component during casting;

(ii) inserting a wear resistant composition in solid form into the one or more cavities formed in the centrifugal slurry pump wear component composed of the host metal composition; and, (iii) bonding the wear resistant composition into the one or more cavities of the centrifugal slurry pump wear component composed of the host metal composition to form the composite metal centrifugal slurry pump wear component, wherein the wear resistant composition is encased within the main body of the composite metal centrifugal slurry pump wear component so that all working surfaces of the composite metal centrifugal slurry pump wear component which, in use, are exposed to wear-inducing materials are composed of the host metal composition without inclusion of the wear resistant composition, and wherein the wear resistant composition has wear resistance which exceeds that of the host metal composition.

2. The method of producing the composite metal centrifugal slurry pump wear component according to claim 1 wherein the casting step (i) includes the following steps:

(ia) positioning one or more cavity forming portions into a mould for the centrifugal slurry pump wear component;

(ib) introducing the host metal composition in liquid form into the mould whereby the host metal composition surrounds the one or more cavity forming portions; and, (ic) allowing the host metal composition in the mould to cool and solidify forming the centrifugal slurry pump wear component composed of the host metal composition.

3. The method of producing the composite metal centrifugal slurry pump wear component according to claim 2 wherein the one or more cavity forming portions is removed from the host metal composition to reveal the one or more cavities after step (ic).

4. The method of producing the composite metal centrifugal slurry pump wear component according to claim 3 wherein the one or more cavity forming portions is removed from the host metal composition by drilling and/or otherwise machining the component composed of the host metal composition after step (ic).

5. The method of producing the composite metal centrifugal slurry pump wear component according to claim 2 wherein the one or more cavity forming portions is at least partially fragmented as the host metal composition in the mould solidifies due to shrinkage of the host metal composition during step (ic).

6. The method of producing the composite metal centrifugal slurry pump wear component according to claim 3 wherein the component composed of the host metal composition is heat treated and/or undergoes a tempering treatment to remove any residual stresses resulting from the formation of the one or more cavities after the one or more cavity forming portions is removed from the component composed of the host metal composition.

7. The method of producing the composite metal centrifugal slurry pump wear component according to claim 1 wherein the wear resistant composition is bonded into the one or more cavities in the host metal using an adhesive or by using a brazing method.

8. A composite metal centrifugal slurry pump wear component including:

a main body portion composed of a host metal composition, the main body portion including one or more cavities located therein; and, a wear resistant composition bonded within the one or more cavities of the main body portion, wherein the one or more cavities are formed during casting of the main body portion and the wear resistant composition is encased within the main body portion of the composite metal centrifugal slurry pump wear component whereby all working surfaces of the composite metal centrifugal slurry pump wear component that, in use, are exposed to wear-inducing substances are composed of the host metal composition without inclusion of the wear resistant composition and wherein the wear resistant composition has wear resistance which exceeds that of the host metal composition.

9. The composite metal centrifugal slurry pump wear component according to claim 8 wherein the host metal composition is selected from a high chrome white cast iron.

10. The composite metal centrifugal slurry pump wear component according claim 8 wherein the wear resistant composition is selected from tungsten carbide.

11. The composite metal centrifugal slurry pump wear component according to claim 8 wherein the wear resistant composition is bonded into the one or more cavities in the host metal using an adhesive or by using a brazing method.

12. The composite metal centrifugal slurry pump wear component according to claim 8 wherein the one or more cavities are located within the main body portion of the composite wear component adjacent to a wear surface of the composite metal wear component.

13. A slurry pump impeller including a back shroud with an inner main face with an outer peripheral edge and a central axis, a plurality of pumping vanes extending away from the inner main face of the back shroud, the pumping vanes being disposed in spaced apart relation, each pumping vane including opposed main side faces, a leading edge in a region of the central axis and a trailing edge in a region of the outer peripheral edge of the back shroud with a passageway between adjacent pumping vanes, wherein the pumping vanes include one or more cavities located within a body portion of the pumping vanes, the one or more cavities each including an opening located in a top surface of the plurality of pumping vanes between the opposed main side faces and remote from the back shroud and extending through the body portion of each of the plurality of pumping vanes from the opening towards the back shroud, and wherein a wear resistant composition is bonded at least partially within the one or more cavities.

14. The slurry pump impeller according to claim 13 wherein the one or more cavities are located within the body portion of each of the plurality of pumping vanes whereby the wear resistant composition is exposed to other than the passageway between adjacent pumping vanes.

15. The slurry pump impeller according to claim 13 wherein the one or more cavities extend through the body portion of each of the plurality of pumping vanes from the opening until in line with where the plurality of the pumping vane meets the back shroud.

16. The slurry pump impeller according to claim 13 wherein the one or more cavities are located proximal to the leading edge of the plurality of pumping vanes.

17. A slurry pump impeller comprising a main body portion including a back shroud with an inner main face, with an outer peripheral edge and a central axis, a plurality of pumping vanes extending away from the inner main face of the back shroud, the pumping vanes being disposed in spaced apart relation, each pumping vane including opposed main side faces, a leading edge in a region of the central axis and a trailing edge in a region of the outer peripheral edge of the back shroud with a passageway between adjacent pumping vanes, wherein the main body portion is composed of a host metal composition and includes one or more cavities located therein, the one or more cavities including a wear resistant composition bonded therewithin, wherein the wear resistant composition is encased within the main body portion of the impeller whereby working surfaces of the impeller, including the surfaces of the pumping vanes, the leading edge of the pumping vanes and the passageways, are composed of the host metal composition without inclusion of the wear resistant composition, and wherein the wear resistant composition has wear resistance which exceeds that of the host metal composition.

18. The slurry pump impeller according to claim 17 including a front shroud having an inner main face wherein the plurality of pumping vanes extend between the inner main faces of the back and front shrouds.

19. The slurry pump impeller according to claim 17 wherein each of the plurality of pumping vanes includes at least one cavity.

20. The slurry pump impeller according to claim 17 wherein the one or more cavities are located within a body portion of each of the plurality of pumping vanes whereby the wear resistant composition is not exposed to the passageway between adjacent pumping vanes.

21. The slurry pump impeller according to claim 17 wherein the one or more cavities each include an opening located in a top surface of the plurality of pumping vanes between the opposed main side faces and remote from the back shroud.

22. The slurry pump impeller according to claim 21 wherein the one or more cavities extend through the body portion of each of the plurality of pumping vanes from the opening towards the back shroud.

23. The slurry pump impeller according to claim 21 wherein the one or more cavities extend through the body portion of each of the plurality of pumping vanes from the opening until in line with where the plurality of the pumping vane meets the back shroud.

24. The slurry pump impeller according to claim 21, wherein the one or more cavities are located proximal to the leading edge of the plurality of pumping vanes.

25. The slurry pump impeller according to claim 21, wherein the one or more cavities are located within from 5 mm to 25 mm from the leading edge of the plurality of pumping vanes.

26. A pump liner for a centrifugal slurry pump, the pump liner comprising a main body portion including a main pumping chamber having an inlet opening for an introduction of flow of material into the main pumping chamber during use, a discharge outlet extending from the main pumping chamber and arranged for an exit of a flow of material from the main pumping chamber during use, and a transition surface extending between an inner peripheral surface of the main pumping chamber and an inner peripheral surface of the discharge outlet, the transition surface including a cutwater arranged for separating an in use exit flow of material in the discharge outlet from an in use recirculation flow of material in the main pumping chamber;

wherein the main body portion is composed of a host metal composition and includes one or more cavities located therein, the one or more cavities including a wear resistant composition bonded therewithin, wherein the wear resistant composition is encased within the main body portion of the pump liner whereby working surfaces of the pump liner including the surfaces of the main pumping chamber, transition surface and cutwater are composed of the host metal composition without inclusion of the wear resistant composition, and wherein the wear resistant composition has wear resistance which exceeds that of the host metal composition.

27. The pump liner according to claim 26, wherein the one or more cavities are located within a body portion of a region of the transition surface whereby the wear resistant composition is not exposed to the main pumping chamber.

28. The pump liner according to claim 26, wherein the one or more cavities each include an opening located in an outside surface of the pump liner in a region of the transition surface.

29. The pump liner according to claim 26 wherein the pump liner includes at least one cavity which includes two openings located on an outside surface on opposite sides of the pump liner wherein the wear resistant composition is located proximal to the cutwater.

30. The pump liner according to claim 26, wherein the one or more cavities are located within from 5 mm to 25 mm from the transition surface.

31. The pump liner according to claim 26, wherein in use the wear resistant composition becomes exposed as the cutwater and/or the transition surface is subjected to wear.

* * * * *